US005201650A

United States Patent [19]

Johnson

[11] Patent Number: 5,201,650

[45] Date of Patent: Apr. 13, 1993

[54] PREMIXED/HIGH-VELOCITY FUEL JET LOW NO BURNER

[75] Inventor: Gregory L. Johnson, Houston, Tex.

[73] Assignee: Shell Oil Company, Houston, Tex.

[21] Appl. No.: 865,538

[22] Filed: Apr. 9, 1992

[51] Int. Cl.[5] ..... F23M 3/00

[52] U.S. Cl. ..... 431/9; 431/115; 431/187; 431/285

[58] Field of Search ..... 431/8, 9, 10, 4, 181, 431/187, 285, 284, 278, 115, 116

[56] References Cited

U.S. PATENT DOCUMENTS

| | | | |
|---|---|---|---|
| 4,331,638 | 5/1982 | Michelfelder . | |
| 4,351,632 | 9/1982 | Nagai . | |
| 4,388,062 | 6/1983 | Bartok et al. . | |
| 4,395,223 | 7/1983 | Okigami et al. . | |
| 4,496,306 | 1/1985 | Okigami et al. . | |
| 4,505,666 | 3/1985 | Martin et al. . | |
| 4,533,314 | 8/1985 | Herberling . | |
| 4,629,413 | 12/1986 | Michelson | 431/9 |
| 4,669,399 | 6/1987 | Martin et al. . | |
| 4,995,807 | 2/1991 | Rampley et al. | 431/9 |

FOREIGN PATENT DOCUMENTS

| | | |
|---|---|---|
| 0074930 | 6/1977 | Japan . |
| 0164209 | 8/1982 | Japan . |

*Primary Examiner*—James C. Yeung
*Attorney, Agent, or Firm*—Timothy J. Hadlock

[57] ABSTRACT

The invention is a process for combusting a gaseous fuel in a burner to result in low $NO_x$ emissions by first feeding a gaseous fuel stream and an air stream to a premixer where the fuel and air streams are mixed to form a fuel-air mixture. The fuel and air streams are fed to the premixer at a fuel to air equivalence ratio of less than 1 (i.e., fuel-lean). Second, the fuel-air mixture is passed to a combustion chamber where the fuel is substantially combusted to produce a combustion chamber jet and flue gases. The combustion chamber jet and flue gases pass into a heating zone which may include a furnace, heater, or boiler. Third, at least two high-velocity fuel streams, optionally diluted with a nonreactive thermal ballast, are passed to the heating zone contemporaneously with the second step. The high-velocity fuel streams entrain at least a portion of the flue gases. The fuel in the high-velocity fuel streams is partially combusted prior to coming into contact with the combustion chamber jet. Last, the flue gases are removed from the heating zone.

12 Claims, 2 Drawing Sheets

PREMIXED/HIGH-VELOCITY FUEL JET LOW NO BURNER

FIELD OF THE INVENTION

This invention relates to a process for operating a premixed, high-velocity fuel jet burner having reduced nitrogen oxides emissions.

BACKGROUND OF THE INVENTION

A variety of combustion processes produce different classifications of nitrogen oxides ($NO_x$). "Fuel NO" oxidation of nitrogen components contained in various fuels. "Prompt NO " results from NO promptly formed when hydrocarbon fuels such as fuel oil, kerosene, and LPG are burned at an air ratio (the ratio of the actual air supply to amount of air stoichiometrically required for the combustion of fuel) of about 0.5 to 1.4, permitting hydrocarbons to react with the nitrogen in the air and further to undergo several reactions. "Thermal NO" is produced when the nitrogen and oxygen in the air react at a high temperature in the course of combustion.

With the advent of contemporary environmental emission standards being imposed by various governmental authorities and agencies involving ever stricter regulations, methods and apparatus to suppress the formation of nitrogen oxides during combustion of hydrocarbon fuels with air are becoming increasingly numerous.

Previously known methods for reducing nitrogen oxide production include: (1) a method in which air is supplied in two stages to form a first-stage combustion zone having an air ratio of up to 1.0 and a second-stage combustion zone down-stream from the first-stage zone with a supplemental air supply; (2) a method which uses a combustion furnace equipped with a plurality of burners and in which air is supplied to each burner at an excessive or somewhat insufficient rate relative to the fuel supply to effect combustion is admixed with the fuel on the air for combustion by circulation; and (3) a method in which the exhaust gas resulting from combustion is admixed with the fuel or the air for combustion by circulation.

The first of these methods of reducing $NO_x$ is unable to suppress the formation of prompt NO when the air ratio of the first-stage combustion zone is in the usual range of 0.5 to 1.0. Even if it is attempted to inhibit the formation of prompt NO to the greatest possible extent as by maintaining the air ratio at about 0.5, the unburned components will react with the secondary air where it is supplied, giving prompt NO. Thus the method fails to produce the desired result. With the second method in which the fuel is burned at an air ratio (usually 0.6 to 1.4) at which each burner can burn the fuel independently of another, the formation of thermal NO and prompt NO inevitably results. The third method is not fully feasible since the exhaust, if circulated at an increased rate to effectively inhibit $NO_x$, will impair steady combustion.

Other known methods have burned a fuel-lean mixture in a primary stage and fuel-rich in a secondary stage diluted with flue gas where the second stage is located radially around the primary stage as in U.S. Pat. No. 4,496,306 (the '306 patent). The '306 patent, however, does not teach premixing the first-stage mixture and does not teach diluting the second-stage mixture with steam or other inert fluids. Previous methods have also taught diluting with water a down stream radially located secondary stage as in Japanese Patent No. 52-74930. Dilution with steam is not taught in the secondary stage and premixing of the first stage is not taught. It would be advantageous to have a process of reducing nitrogen oxide formation which overcomes the deficiencies of previously known methods.

SUMMARY OF THE INVENTION

The invention is a process for combusting a gaseous fuel in a burner to produce a combustion mix having a low $NO_x$ content thereby resulting in low $NO_x$ emissions. Firstly, a gaseous fuel stream and an air stream are fed to a premixer where the fuel and air streams are mixed to form a fuel-air mixture. The fuel and air streams are fed to the premixer in a fuel to air equivalence ratio of less than 1, i.e., fuel-lean. The fuel-air mixture can also include flue gas recycled from the combustion chamber ("recycled flue gas"). Secondly, the resulting fuel-air mixture is passed to a combustion chamber where the fuel is substantially combusted to produce a combustion chamber jet and flue gases. The resulting combustion chamber jet and flue gases pass into a heating zone. Thirdly, at least two high-velocity fuel streams are passed to the heating zone contemporaneously with the combustion chamber jet and flue gases. The high-velocity fuel streams entrain at least a portion of the flue gases which recirculate within the chamber ("recirculated flue gas"). The fuel in the high-velocity fuel streams and any fuel in the entrained flue gas is partially combusted prior to coming into contact with the combustion chamber jet. Lastly, the flue gases are removed from the heating zone.

DESCRIPTION OF THE PREFERRED EMBODIMENT(S)

Figure 1:
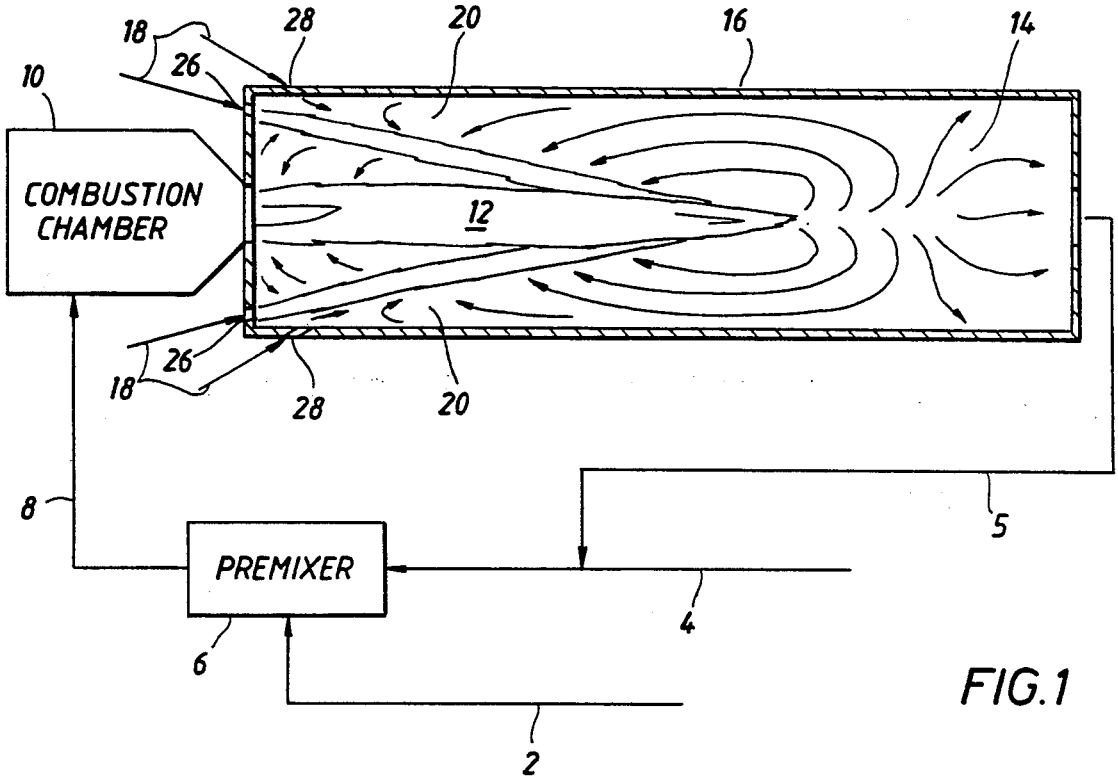
FIG. 1 depicts a flow chart of the method.

The invention is a process for combusting a gaseous fuel in a burner to result in low $NO_x$ emissions by first feeding a gaseous fuel stream and an air stream optionally mixed with recirculated flue gas to a premixer where the fuel-air mixture is substantially fully mixed. Referring to FIG. 1, the fuel stream 2 and air stream 4, and optionally recycled flue gas stream 5, are fed to the premixer 6 at a fuel to air equivalence ratio of less than 1 (i.e., fuel-lean), preferably between about 0.4 and 0.7. It is known that $NO_x$ production sharply decreases when the fuel-air mixture decreases. Thus combusting this fuel-lean mixture results in low $NO_x$ production.

The resulting fuel-air mixture stream 8 is passed to and recirculated within a combustion chamber 10. The fuel-air mixture from the premixer should be sufficiently recirculated in the combustion chamber to maintain combustion of the fuel-lean, fuel-air mixture. In the combustion chamber the fuel is substantially combusted to produce a combustion chamber jet 12, i.e., a product stream from the combustion, and flue gases 14. The combustion chamber jet and flue gases pass into a heating zone 16 such as a furnace, heater, or broiler. Third, in addition to the combustion chamber jet and flue gases from the combustion chamber, at least two uncombusted high-velocity fuel streams 18 are passed to the radiant section 20 of the heating zone contemporaneously with the passing of the combustion chamber jet and flue gases to the heating zone. The high-velocity fuel streams have a velocity of at least Mach 0.2.

Figure 3:
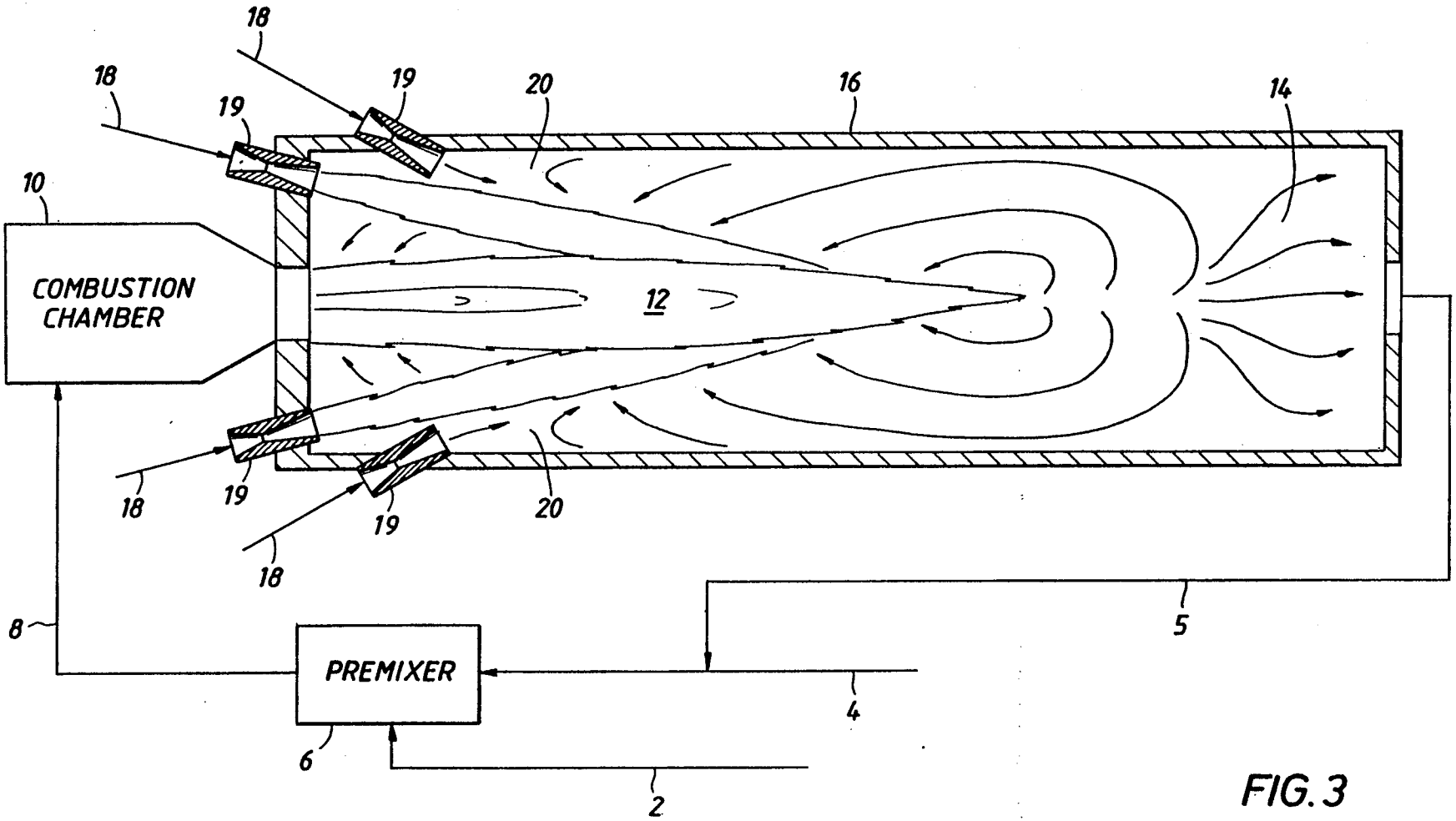

Unlike the other fuel streams the high-velocity fuel streams pass directly into the heating zone and not through the premixer or combustion chamber. The velocity may be imparted to the high-velocity fuel streams by expanding the fuel through a convergent/divergent nozzle 19 (FIG.3). The high-velocity fuel streams are preferably diluted by up to about 300% wt. based on the weight of the high-velocity fuel streams with a nonreactive thermal ballast prior to coming into contact with said combustion chamber jet. When a nonreactive thermal ballast is used it is preferably stream, water, recycled or recirculated flue gas, or mixtures thereof. Thus the high velocity may be imparted to the fuel by entraining the fuel in a high pressure ballast before, during, or after the ballast is expanded through a convergent/divergent nozzle. The high velocity may also be imparted by admixture of the fuel with a high-velocity water stream. Other conventional methods for imparting a high velocity to the fuel stream may also be used.

When a thermal ballast is used the dilution is achieved by way of a compound injection nozzle where the high-velocity fuel streams substantially entrain the ballast gas prior to coming into contact with said combustion chamber jet. The high-velocity fuel streams entrain at least a portion of the flue gases. Preferably the flue gases entrained in the high-velocity fuel streams contain about or less than 3% wt. oxygen.

Figure 2:
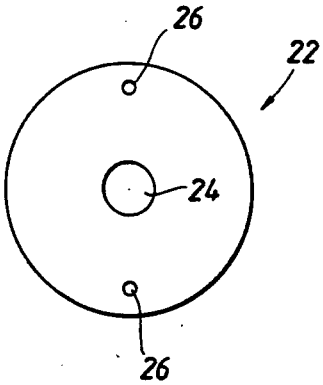
FIG. 2 depicts and end view of the heating zone where the heating zone is a cylindrical vessel and FIG. 3 depicts a cross-sectional view of a burner employing divergent/convergent nozzles.

Referring to FIGS. 1 and 3, where the heating zone 16 (FIG. 1) ia s a cylindrical vessel it will have circular feed end section 22 (FIG. 2). The combustion chamber jet will preferably feed into the heating zone through a center area 24 (FIG. 2) of the circular feed end section. The high-velocity fuel streams 18 (FIG. 1) are preferably passed into the radiant section 20 (FIG. 1) at two or more points 26 (FIGS. 1 and 2) on the circular feed end section between the center and outer edges of the circular end section. However, the high-velocity fuel streams may also be fed into the heating zone at two or more points 28 (FIG.1) on the cylindrical section of the heating zone. The fuel in the high-velocity fuel streams is partially combusted prior to coming into contact with the combustion chamber jet. Lastly, the flue gases are removed from the heating zone. The concentration of $NO_x$ in the flue gases removed is preferably less than about 10 ppm. This process lowers $No_x$ emissions while avoiding the problems of maintaining consistent combustion that were caused by prior art methods.

The ranges and limitations provided in the instant specification and claims are those which are believed to particularly point out and distinctly claim the instant invention. It is, however, understood that other ranges and limitations that perform substantially the same function in substantially the same way to obtain substantially the same result are intended to be within the scope of the instant invention as defined by the instant specification and claims.

What is claimed is:

1. A process for combusting a gaseous fuel in a burner having low $NO_x$ emissions comprising:

(a) feeding a gaseous fuel stream and an air stream to a premixer wherein said fuel and air streams are substantially fully mixed to form a fuel-air mixture wherein said fuel and air streams are fed to said premixer at a fuel to air equivalence ratio of less that 1;

(b) passing said fuel-air mixture to a combustion chamber wherein said fuel is substantially combusted to produce a combustion chamber jet and flue gases whereby said combustion chamber jet and flue gases pass into a heating zone selected from a furnace, heater, or boiler;

(c) passing to said heating zone, comtemporaneously with said combustion chamber jet and flue gases, at least two high-velocity fuel streams, wherein said high-velocity fuel streams are diluted by up to about 300% wt. based on the weight of the high-velocity fuel streams with a nonreactive thermal ballast selected from water, steam, recycled or recirculated flue gas, or mixtures thereof, prior to coming into contact with said combustion chamber jet, wherein said high-velocity fuel streams entrain at least a portion of said flue gases, wherein the fuel in the high-velocity fuel streams is substantially combusted prior to coming into contact with the combustion chamber jet; and (d) removing said flue gases from said heating zone.

2. The process according to claim 1 wherein the equivalence ratio of fuel to air in step (a) is between about 0.4 and 0.7.

3. The process according to claim 2 wherein said heating zone comprises a radiant section and wherein said high-velocity fuel streams are passed, in step (c), into said radiant section.

4. The process according to claim 3 wherein step (c) said high-velocity fuel streams are diluted with said nonreactive thermal ballast by way of a compound injection nozzle and wherein said high-velocity fuel streams substantially entrain said ballast and entrain a recirculated flue gas prior to coming into contact with said combustion chamber jet.

5. The process according to claim 4 wherein in step (c) the nonreactive thermal ballast is steam or water.

6. The process according to claim 1 wherein said flue gases entrained by said high-velocity fuel streams in step (c) contains at most about 3% wt. oxygen.

7. The process according to claim 1 wherein in step (b) there is sufficient recirculation of the fuel-air mixture in the combustion chamber to maintain combustion of the fuel-lean, fuel-air mixture.

8. The process according to claim 2 wherein in step (c) velocity is imparted to said high-velocity fuel streams by high pressure expansion of steam or fuel through a convergent/divergent nozzle.

9. The process according to claim 2 wherein in step (c) velocity is imparted to said high-velocity fuel streams by admixture of the fuel with a high-velocity water stream.

10. The process according to claim 6 wherein the concentration of $NO_x$ in the flue gases removed in step (d) is less than about 10 ppm.

11. The process according to claim 1 wherein said fuel-air mixture includes a recycled flue gas.

12. A process for combusting a gaseous fuel in a burner having low $NO_x$ emissions comprising:

(a) feeding a gaseous fuel stream, an air stream and a recycled flue gas stream to a premixer wherein said fuel and air streams are substantially fully mixed to form a fuel-air mixture wherein said fuel and air streams are fed to said premixer at a fuel to air equivalence ratio of between about 0.4 and 0.7;

(b) passing said fuel-air mixture to a combustion chamber, wherein said fuel is substantially combusted to produce a combustion chamber jet and flue gases, wherein there is sufficient recirculation of the fuel-air mixture in the combustion chamber to maintain combustion of the fuel-lean, fuel-air mixture, whereby said combustion chamber jet and flue gases pass into a heating zone selected from a furnace, heater, or boiler;

(c) passing into a radiant section of said heating zone, contemporaneously with the combustion chamber jet and flue gases, at least two high-velocity fuel streams, wherein the velocity is imparted to said high-velocity fuel streams by expansion of high pressure steam or fuel through a convergent/divergent nozzle, or by admixture of the fuel with high-velocity water; said high-velocity fuel streams are diluted by up to about 300% wt. based on the weight of the high-velocity fuel streams with non-reactive thermal ballast selected from steam, water, recycled or recirculated flue gas, or mixtures thereof, by way of a compound injection nozzle and wherein said high-velocity fuel streams partially entrain said ballast prior to coming into conduct with said combustion chamber jet, said high-velocity fuel streams entraining at least a portion of said flue gases wherein said flue gases contain about or less than 3% wt. oxygen and wherein the fuel in the high-velocity fuel streams is partially combusted prior to coming into contact with the combustion chamber jet; and (d) removing said flue gases from said heating zone wherein said flue gases contain less than about 10 ppm $NO_x$.

* * * * *